US010011955B2

(12) United States Patent
Matsuo et al.

(10) Patent No.: US 10,011,955 B2
(45) Date of Patent: Jul. 3, 2018

(54) TRANSPORT SYSTEM

(71) Applicant: IHI Corporation, Tokyo (JP)

(72) Inventors: Yoshihiro Matsuo, Tokyo (JP); Mitsunori Yamane, Hiroshima (JP)

(73) Assignee: IHI CORPORATION, Tokyo (JP)

( * ) Notice: Subject to any disclaimer, the term of this patent is extended or adjusted under 35 U.S.C. 154(b) by 231 days.

(21) Appl. No.: 14/992,179

(22) Filed: Jan. 11, 2016

(65) Prior Publication Data

US 2016/0122949 A1 May 5, 2016

Related U.S. Application Data

(63) Continuation of application No. PCT/JP2014/073502, filed on Sep. 5, 2014.

(30) Foreign Application Priority Data

Sep. 25, 2013 (JP) ..... 2013-198916

(51) Int. Cl.
*E01B 11/42* (2006.01)
*E01B 11/56* (2006.01)

(52) U.S. Cl.
CPC ..... *E01B 11/42* (2013.01); *E01B 11/56* (2013.01)

(58) Field of Classification Search
CPC . B66C 7/04; B61B 13/00; E01B 11/02; E01B 11/42; E01B 11/56; E01B 23/00; E01B 25/00; E01B 26/00
USPC ..... 238/10 R
See application file for complete search history.

(56) References Cited

U.S. PATENT DOCUMENTS 6,523,957 B1 2/2003 Walton et al.
6,682,294 B2 * 1/2004 Carroll ..... B60P 1/43 14/69.5
8,915,690 B2 12/2014 Ota
2012/0275886 A1 11/2012 Ota

FOREIGN PATENT DOCUMENTS

CN 102465479 A 5/2012
CN 102556559 A 7/2012
EP 1 746 333 A1 1/2007
JP 59-130901 A 7/1984
(Continued)

OTHER PUBLICATIONS

International Search Report dated Nov. 25, 2014 in PCT/JP2014/073502 (with an English translation) (4 pages).
(Continued)

*Primary Examiner* — Mark T Le
(74) *Attorney, Agent, or Firm* — Rothwell, Figg, Ernst & Manbeck, P.C.

(57) ABSTRACT

A transport system includes: a pair of first traveling rails (R1) affixed to and laid on a floor (F1); a pair of second traveling rails (R2) laid on another floor (F2) to be able to move in a laying direction thereof; a pair of intermediate traveling rails (RM) each including a first end and a second end, the first end being rotatably connected to an end portion of each of the first traveling rails (R1), the second end being rotatably connected to an end portion of each of the second traveling rails (R2); and a transport dolly (D) which travels on the first traveling rails (R1), the intermediate traveling rails (RM), and the second traveling rails (R2).

20 Claims, 9 Drawing Sheets

(56) References Cited

FOREIGN PATENT DOCUMENTS

| | | | |
|---|---|---|---|
| JP | 60-65801 | A | 4/1985 |
| JP | 5-97030 | A | 4/1993 |
| JP | 6-280207 | A | 10/1994 |
| JP | 3077571 | B2 | 8/2000 |
| JP | 2000-297402 | A | 10/2000 |
| JP | 2001-31367 | A | 2/2001 |
| JP | 2001-63803 | A | 3/2001 |
| JP | 2002-19604 | A | 1/2002 |
| JP | 2005-225583 | A | 8/2005 |
| JP | 2006-77537 | A | 3/2006 |
| JP | 2006-219864 | A | 8/2006 |
| JP | 2010-180051 | A | 8/2010 |
| JP | 2011-132760 | A | 7/2011 |
| JP | 2012-106814 | A | 6/2012 |
| WO | 2013/058162 | A1 | 4/2013 |

OTHER PUBLICATIONS

Office Action dated Sep. 21, 2015 in corresponding Taiwan Patent Application No. 103131119 (with an English translation) (9 pages).
English machine translation of WO 2013/058162 A1 (17 pages).

* cited by examiner

TRANSPORT SYSTEM

This application is a Continuation of International Application No. PCT/JP2014/073502, filed on Sep. 5, 2014, claiming priority based on Japanese Patent Application No. 2013-198916, filed on Sep. 25, 2013, the contents of both International application and the Japanese Application are incorporated herein by reference in their entirety.

TECHNICAL FIELD

Embodiments described herein relates to a transport system and particularly to a transport system which transports a cargo between a floor and another floor which can move relative to each other.

BACKGROUND ART

In the interior of a warehouse (an automatic warehouse) of, for example, a distribution center or the like, a seismically isolated floor is sometimes adopted in order to prevent collapse of cargo due to swaying of a rack accommodating cargo at the time of an earthquake. On the other hand, outside (in a cargo handling building or the like) of the warehouse, a normal floor rather than a seismically isolated floor is provided in order to reduce construction costs. A transport dolly is used for the transport of a cargo between a seismically isolated floor area and a normal floor area, and a first rail on which the transport dolly travels is laid on the seismically isolated floor, and a second rail is laid on the normal floor to be connected to the first rail.

In such a transport system, in a case where when the seismically isolated floor and the normal floor move relative to each other at the time of earthquake, a connection portion between the first rail and the second rail is damaged and each rail is bent and deformed, it takes a long time to repair this after the earthquake. Therefore, a transport system made such that a connection rail is interposed between a first rail and a second rail, and the connection rail is actively disconnected when the first rail on a seismically isolated floor and the second rail on a normal floor move relative to each other at the time of an earthquake, is proposed (refer to, for example, Patent Document 1).

CITATION LIST

Patent Literature

[Patent Document 1] Japanese Patent No. 3077571

SUMMARY OF DISCLOSURE

Technical Problem

In the transport system disclosed in Patent Document 1 described above, if the first rail and the second rail move relative to each other at the time of an earthquake, the connection rail is easily disconnected from the first rail and the second rail, and therefore, excessive force due to the earthquake is not applied to the first rail and the second rail, and thus it is possible to prevent bending, deformation, breakage, or the like of the rails.

However, for example, in a case where an earthquake occurs when the transport dolly is traveling on the connection rail, the connection rail is disconnected from the first rail and the second rail, whereby the transport dolly is derailed and overturned or falls down, and thus there is a possibility that the transport dolly or peripheral equipment may be damaged. Further, in a case where the transport dolly or the peripheral equipment is damaged, it takes a long time to repair this after the earthquake.

The present disclosure has been made in order to overcome the above problem and has an object to provide a transport system in which even in a case where a relative movement occurs between a floor and another floor, it is possible to prevent the breakage of the rails, and thus it is possible to prevent the derailment or the falling of a transport dolly.

Solution to Problem

According to a first aspect of the present disclosure, there is provided a transport system transporting a cargo between a floor and another floor which are disposed with a distance therebetween and are able to move relative to each other, including: a pair of first traveling paths configured not to move relative to the floor; a pair of second traveling paths laid on the another floor to be able to move in a laying direction thereof; a pair of intermediate traveling paths each including a first end and a second end, the first end being rotatably connected to an end portion of each of the first traveling paths or the floor, the second end being rotatably connected to an end portion of each of the second traveling paths; and a transport dolly which travels on the first traveling paths, the intermediate traveling paths, and the second traveling paths.

According to a second aspect of the present disclosure, in the first aspect, the transport system further includes: a first guide rail laid parallel to the first traveling paths and affixed to the floor; a second guide rail laid parallel to the second traveling paths and able to move in the laying direction thereof on the another floor; and an intermediate guide rail including a first end and a second end, the first end being rotatably connected to an end portion of the first guide rail, the second end being rotatably connected to an end portion of the second guide rail, wherein the transport dolly has a guide member movable along the first guide rail, the intermediate guide rail, and the second guide rail.

According to a third aspect of the present disclosure, in the second aspect, the guide member is provided with a guide roller which can roll along the first guide rail, the intermediate guide rail, and the second guide rail, and a roller bracket which supports the guide roller, and the roller bracket is mounted on the transport dolly to be able to rotate around a vertical shaft.

According to a fourth aspect of the present disclosure, in any one of the first to third aspects, a traveling wheel of the transport dolly has a width corresponding to a minimum value and a maximum value of a gauge distance occurring in the intermediate traveling paths due to a relative movement of the first traveling paths and the second traveling paths.

According to a fifth aspect of the present disclosure, in any one of the first to fourth aspects, a floorboard configured to cover a distance between the floor and the another floor is disposed at a portion below each of the intermediate traveling paths.

According to a sixth aspect of the present disclosure, in any one of the first to fifth aspects, a cargo receiving section which receives a cargo from the transport dolly is disposed at the another floor in the side of the second traveling paths.

According to the transport system according to the present disclosure, the first traveling paths are disposed on the floor, the second traveling paths are disposed to be able to move in the laying direction thereof with respect to the another floor, and each of the intermediate traveling paths is rotatably connected to each of the first traveling paths and each of the second traveling paths. Therefore, even in a case where the floor and the another floor move relative to each other due to an earthquake or the like, it is possible to prevent breakage of the traveling paths. That is, with respect to a relative movement in a right-left direction, each of the intermediate traveling paths rotates with respect to each of the first traveling paths and each of the second traveling paths, thereby absorbing the movement amount, and with respect to a relative movement in the laying direction of the traveling paths, the second traveling paths move in the laying direction thereof, whereby it is possible to absorb the movement amount. Further, by preventing breakage of the traveling paths, it is possible to prevent derailment or the falling of the transport dolly.

DESCRIPTION OF EMBODIMENTS

Figure 1A:
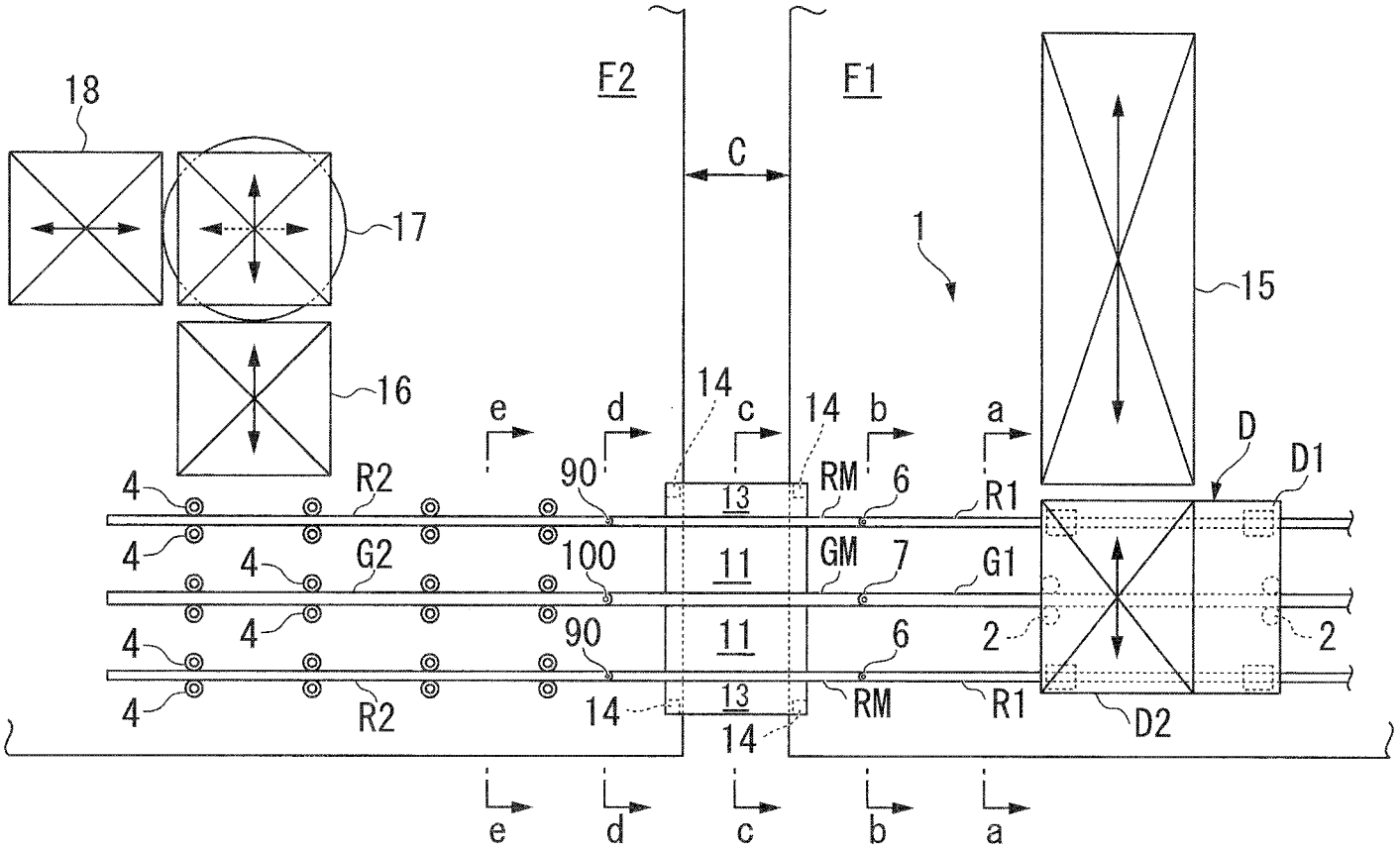
FIG. 1A is a plan view of a transport system according to a first embodiment of the present disclosure.

Hereinafter, embodiments of the present disclosure will be described in detail with reference to the accompanying drawings. Dimensions, materials, other specific numerical values, and the like which are used in this description are merely exemplification for facilitating understanding of the disclosure and do not limit the present disclosure unless otherwise specified. In addition, in this specification and the drawings, elements having substantially the same function and configuration are denoted by the same reference numerals, and thus overlapping description is omitted, and with respect to elements which are not directly related to the present disclosure, illustration thereof is omitted.

Figure 1B:
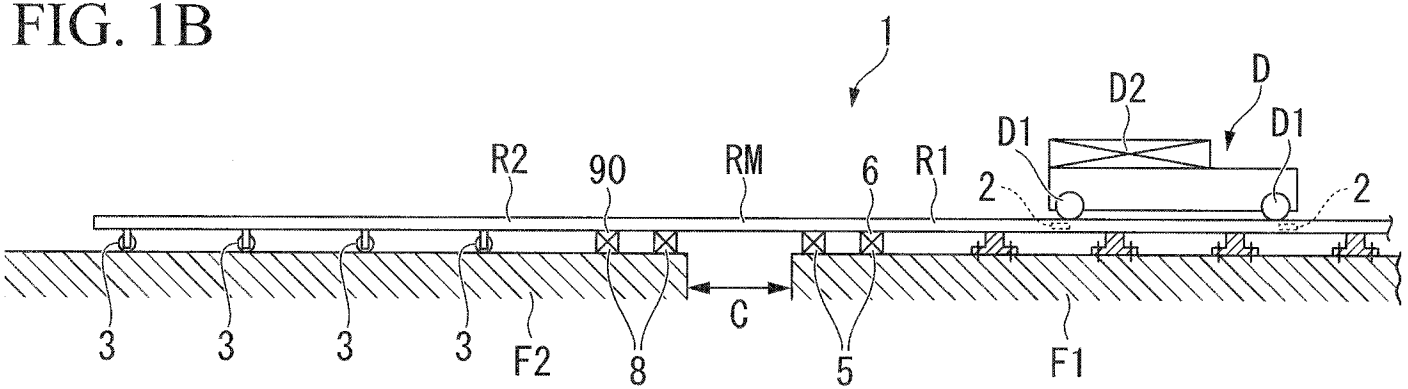
FIG. 1B is a side view of the transport system according to the first embodiment of the present disclosure.

A transport system 1 according to a first embodiment of the present disclosure is a transport system transporting a cargo between a floor F1 and another floor F2 which are disposed with a distance C therebetween and are able to move relative to each other, as shown in FIGS. 1A and 1B, and is provided with a pair of first traveling rails R1 affixed to and laid on the floor F1, a pair of second traveling rails R2 laid on the another floor F2 and is able to move in a laying direction thereof, a pair of intermediate traveling rails RM each including a first end and a second end, the first end being rotatably connected to an end portion of each of the first traveling rails R1, the second end being rotatably connected to an end portion of each of the second traveling rails R2, and a transport dolly D which travels on the first traveling rails R1, the intermediate traveling rails RM, and the second traveling rails R2.

The transport system 1 is provided in, for example, a distribution center provided with an automatic warehouse, a cargo handling building, or the like, and the floor F1 is a seismically isolated floor in the automatic warehouse, and the another floor F2 is a normal floor outside of the automatic warehouse (in the cargo handling building). Further, if the floor F1 and the another floor F2 can move relative to each other, both the floor F1 and the another floor F2 may be seismically isolated floors or may be normal floors. The floor F1 and the another floor F2 are disposed with the distance C therebetween, as shown in the drawings, and the floor F1 and the another floor F2 move relative to each other due to an earthquake or the like, whereby the size of the distance C varies.

The transport dolly D has traveling wheels D1 provided at four corners, and a cargo which is loaded into and unloaded from an automatic warehouse or the like is placed on the transport dolly D. Further, the transport dolly D may be provided with a transfer mechanism D2 such as a conveyor in which it is possible to deliver and receive a cargo to and from a transport device 15 such as a stacker crane which stores a cargo in a rack of the automatic warehouse or takes a cargo out of the rack, for example. In addition, in FIGS. 1A and 1B, illustration of the rack of the automatic warehouse is omitted.

The first traveling rails R1 form a track on the floor F1 by a pair of rail members being affixed to the floor F1 in parallel with a predetermined distance therebetween. Therefore, the first traveling rails R1 are equivalent to a pair of first traveling paths configured not to move relative to the floor F1. Further, the end portion closest to the another floor F2 of each of the first traveling rails R1 is disposed at the position recessed by a certain distance from the end face of the floor F1 facing the another floor F2.

The second traveling rails R2 form a track on the another floor F2 by a pair of rail members being movably disposed on the another floor F2 in parallel with a predetermined distance therebetween. Therefore, the second traveling rails R2 are equivalent to a pair of second traveling paths laid on the another floor F2 to be able to move in the laying direction thereof. Specifically, each of the second traveling rails R2 has a plurality of wheels 3 disposed in a length direction on the lower surface thereof and is configured to be able to slide in the laying direction (the length direction) thereof while maintaining the same height of each of the first traveling rails R1.

Further, on the another floor F2, a plurality of guide rollers 4 which maintains the gauge distance between the second traveling rails R2 and guide the movement of the second traveling rails R2 in the laying direction thereof are disposed. The guide rollers 4 are disposed along, for example, both side surfaces of each of the second traveling rails R2. Due to the guide rollers 4, the gauge distance between the second traveling rails R2 is set to the same gauge distance as the gauge distance between the first traveling rails R1.

Further, in a normal state (a state where the floor F1 and the another floor F2 are stationary and a state where the first movement rail R1, the intermediate traveling rails RM, and the second traveling rails R2 are disposed on a straight line), the end portion closest to the floor F1 of each of the second traveling rails R2 is disposed at the position recessed by a certain distance from the end face of the another floor F2 facing the floor F1.

The intermediate traveling rails RM are rail members which form a single track by connecting the first traveling rails R1 and the second traveling rails R2. Therefore, the intermediate traveling rails RM are equivalent to a pair of intermediate traveling paths each including a first end and a second end, the first end being rotatably connected to an end portion of each of the first traveling paths, the second end being rotatably connected to an end portion of each of the second traveling paths. Each of the intermediate traveling rails RM is pin-connected to each of the first traveling rails R1 and each of the second traveling rails R2 and thus is configured to be rotatable in a horizontal plane. That is, a link mechanism is configured with the first traveling rails R1, the second traveling rails R2, and the intermediate traveling rails RM, and a configuration is made such that the relative movement in a right-left direction of the floor F1 and the another floor F2 can be absorbed by an operation of such a link mechanism.

Here, each of the first traveling rails R1 and each of the intermediate traveling rails RM are connected at a connection section 6, and a first guide rail G1 and an intermediate guide rail GM are connected at a connection section 7. Further, each of the intermediate traveling rails RM and each of the second traveling rails R2 are connected at a connection section 90, and the intermediate guide rail GM and a second guide rail G2 are connected at a connection section 100.

In addition, each of the first traveling rails R1, each of the intermediate traveling rails RM, and each of the second traveling rails R2 are merely an example of each of the first traveling paths, each of the intermediate traveling paths, and each of the second traveling paths.

Further, the right-left direction refers to a direction perpendicular to the laying direction of the traveling rails.

Incidentally, in a case where the floor F1 and the another floor F2 move relative to each other in the right-left direction, the distance between the end portion of each of the first traveling rails R1 and the end portion of each of the second traveling rails R2 in the laying direction thereof is reduced by an amount equal to the distance C between the floor F1 and the another floor F2 as the maximum. That is, assuming that a relative movement angle (a shift angle from a state where each of the first traveling rails R1 and each of the second traveling rails R2 are on a straight line) is $\theta$, a decrease, $1-\cos\theta$, in the distance between the end portion of each of the first traveling rails R1 and the end portion of each of the second traveling rails R2 in the laying direction thereof varies in a range which does not exceed C. Here, the length of each of the intermediate traveling rails RM is set to be 1 for convenience, $\theta$ is less than 90°, and C is less than 1. The variation is absorbed by the movement of each of the second traveling rails R2 on the another floor F2.

Further, in a case where the floor F1 and the another floor F2 move relative to each other in the laying direction of the traveling rails, the second traveling rails R2 are pulled through the intermediate traveling rails RM according to the movement of the first traveling rails R1, and thus the second traveling rails R2 move on the another floor F2. Therefore, the movement amount due to the relative movement in the laying direction of the traveling rails of the floor F1 and the another floor F2 is absorbed by the movement of the second traveling rails R2.

In addition, in an actual earthquake, although a state is created where the relative movements in the right-left direction and the laying direction of the traveling rails of the floor F1 and the another floor F2 are mixed, by the rail configuration described above, it is possible to secure a track while absorbing all the relative movement amounts in the horizontal plane. Therefore, it is possible to prevent breakage of the rails, and thus it is possible to prevent derailment or the falling of the transport dolly.

Further, the transport system 1 shown in the drawings is provided with the first guide rail G1 laid parallel to the first traveling rails R1 and affixed to the floor F1 at an intermediate portion in the gauge of the first traveling rails R1, the second guide rail G2 laid parallel to the second traveling rails R2 to be able to move in the laying direction thereof on the another floor F2 at an intermediate portion in the gauge of the second traveling rails R2, and the intermediate guide rail GM including a first end and a second end, the first end being rotatably connected to an end portion of the first guide rail G1, the second end being rotatably connected to an end portion of the second guide rail G2, and the transport dolly D has a guide member 2 movable along the first guide rail G1, the intermediate guide rail GM, and the second guide rail G2.

The first guide rail G1 is disposed at an approximately central portion in the gauge of the first traveling rails R1 and disposed on the floor F1 with substantially the same configuration as that of each of the first traveling rails R1. Further, the second guide rail G2 is disposed at an approximately central portion in the gauge of the second traveling rails R2 and disposed on the another floor F2 with substantially the same configuration as that of each of the second traveling rails R2. Further, the intermediate guide rail GM is disposed at an approximately central portion in the gauge of the intermediate traveling rails RM and connected to the first guide rail G1 and the second guide rail G2 with substantially the same configuration as that of each of the intermediate traveling rails RM.

Due to such a configuration, the first guide rail G1, the second guide rail G2, and the intermediate guide rail GM respectively have the same operations as those of each of the first traveling rails R1, each of the second traveling rails R2, and each of the intermediate traveling rails RM described above, and even in a case where the floor F1 and the another floor F2 move relative to each other in the right-left direction and the laying direction of the traveling rails, it is possible to secure a track while absorbing all the relative movement amounts in the horizontal plane. Therefore, it is possible to prevent breakage of the rails, and thus it is possible to prevent derailment or the falling of the transport dolly.

In addition, here, a case has been described where the first guide rail G1, the second guide rail G2, and the intermediate guide rail GM are respectively disposed at the intermediate portions in the gauges of the first traveling rails R1, the second traveling rails R2, and the intermediate traveling rails RM. However, the first guide rail G1, the second guide rail G2, and the intermediate guide rail GM may be respectively disposed outside of the gauges of the first traveling rails R1, the second traveling rails R2, and the intermediate traveling rails RM.

Figure 2A:
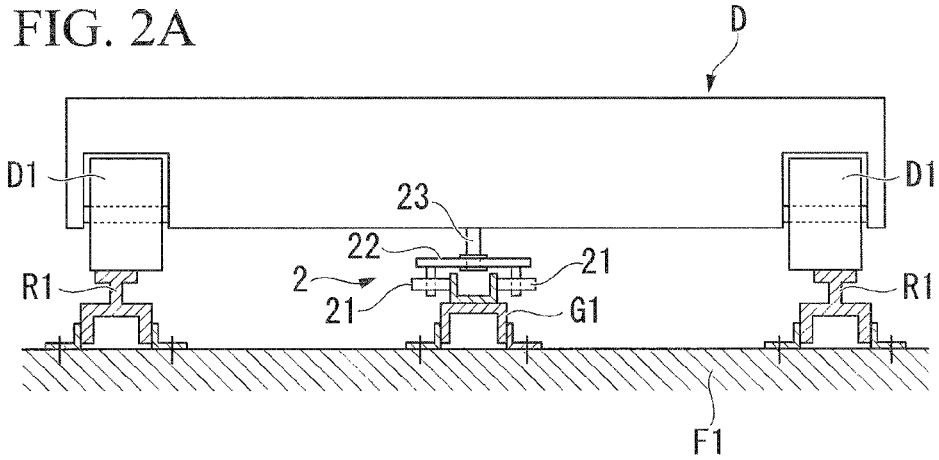
FIG. 2A is a cross-sectional view along line a-a of the transport system shown in FIG. 1A.
Figure 2B:
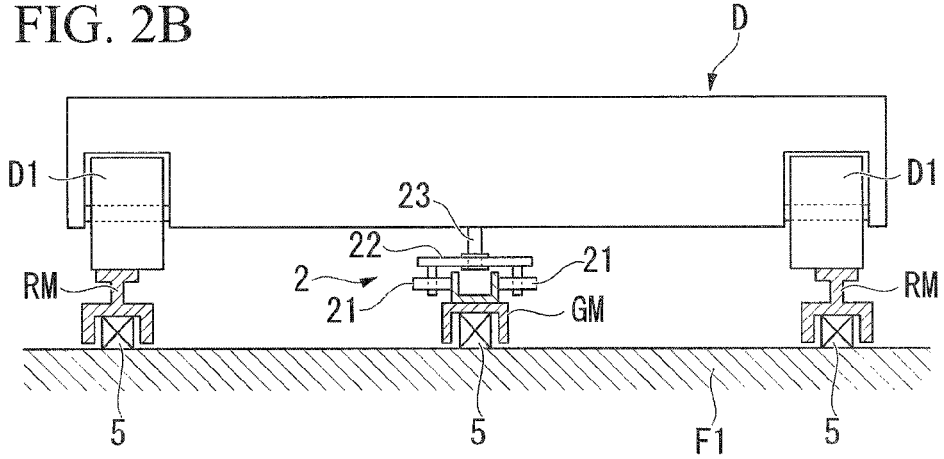
FIG. 2B is a cross-sectional view along line b-b of the transport system shown in FIG. 1A.
Figure 2C:
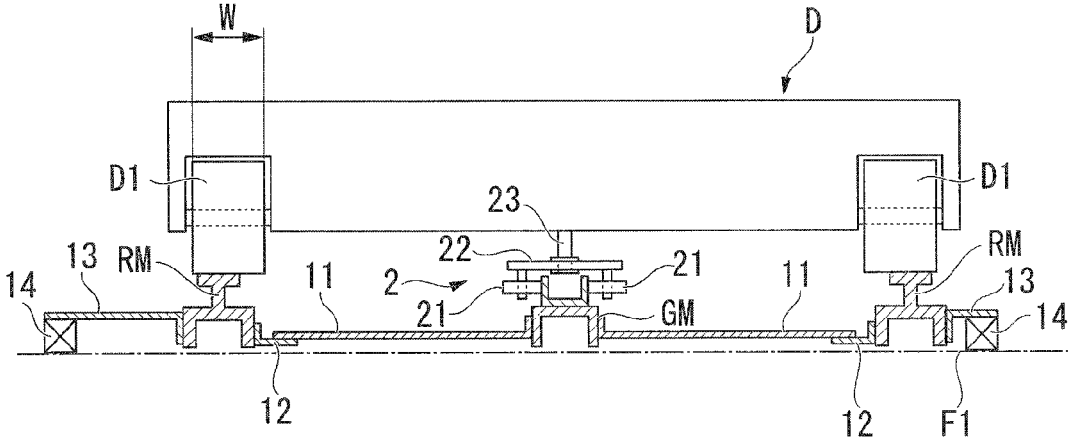
FIG. 2C is a cross-sectional view along line c-c of the transport system shown in FIG. 1A.
Figure 3A:
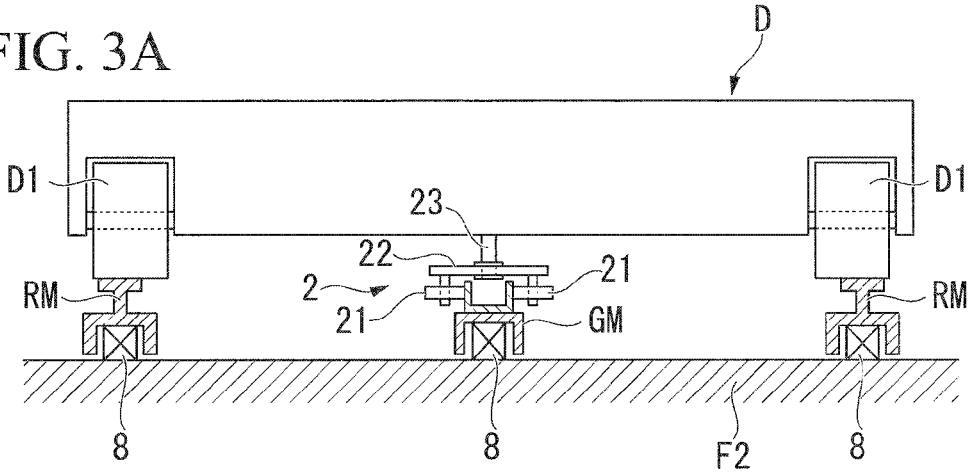
FIG. 3A is a cross-sectional view along line d-d of the transport system shown in FIG. 1A.
Figure 3B:
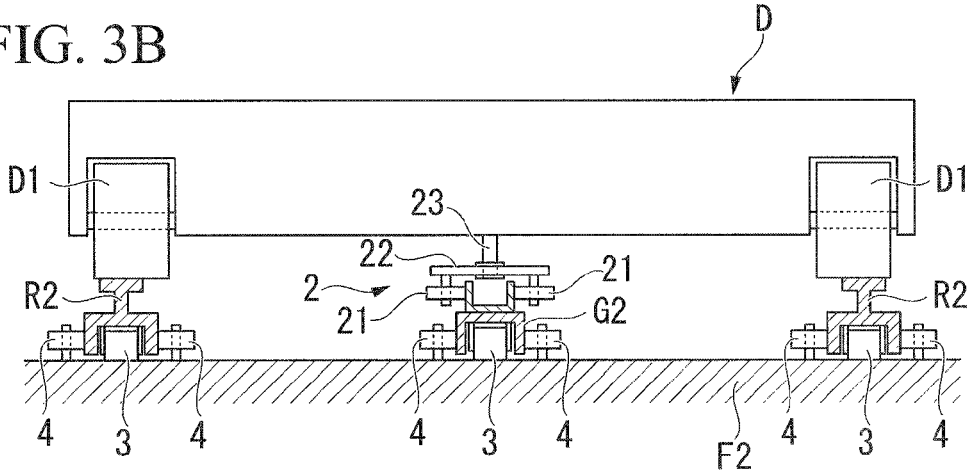
FIG. 3B is a cross-sectional view along line e-e of the transport system shown in FIG. 1A.
Figure 3C:
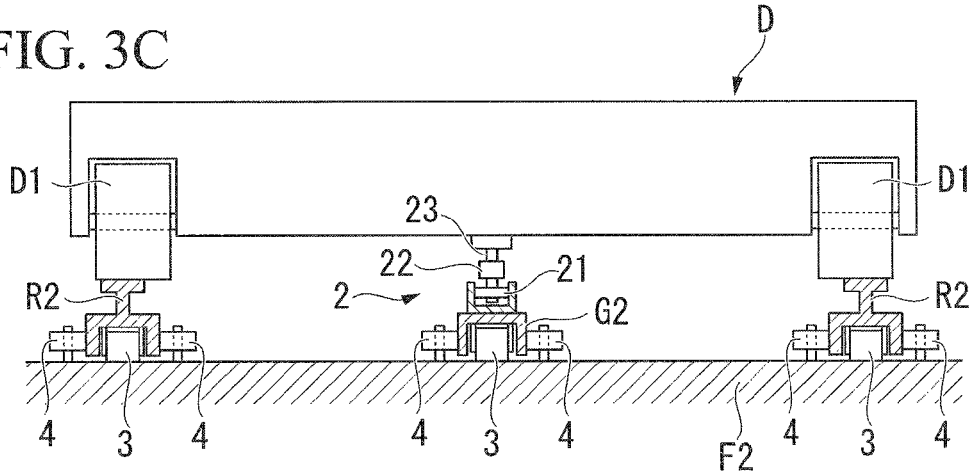
FIG. 3C is a modified example of a guide member.

Hereinafter, the transport system 1 described above will be described in detail based on the cross-sectional views shown in FIGS. 2A to 2C and 3A to 3C. Here, FIG. 2A is a cross-sectional view along line a-a of the transport system shown in FIG. 1A, FIG. 2B is a cross-sectional view along line b-b of the transport system shown in FIG. 1A, and FIG. 2C is a cross-sectional view along line c-c of the transport system shown in FIG. 1A. Further, FIG. 3A is a cross-sectional view along line d-d of the transport system shown in FIG. 1A, FIG. 3B is a cross-sectional view along line e-e of the transport system shown in FIG. 1A, and FIG. 3C is a modified example of the guide member.

As shown in FIG. 2A, the first traveling rails R1 are fixed to the floor F1 by fasteners such as bolts to have a predetermined gauge distance. The traveling wheel D1 of the transport dolly D rolls on the upper surface of each of the first traveling rails R1. Here, in general, at a wheel which travels on a rail, a flange for guiding the wheel along the rail is formed. However, a flange is not formed at the traveling wheel D1 in this embodiment.

The gauge distance of the intermediate traveling rails RM varies due to the relative movement of the floor F1 and the another floor F2, and therefore, in a case where a flange is formed at the traveling wheel D1 of the transport dolly D, it may be necessary to make the wheel distance between the traveling wheels D1 correspond to a variation of the gauge distance. However, a complicated structure is inevitable in order to vary the wheel distance between the traveling wheels D1 and it is also difficult to make the wheel distance correspond to a variation due to a complex relative movement occurring due to an earthquake or the like. Therefore, in this embodiment, a guide mechanism of the transport dolly D is separated from the traveling wheels D1 and the guide member 2 is disposed.

The guide member 2 is provided with a guide roller 21 which can roll along the first guide rail G1, the intermediate guide rail GM, and the second guide rail G2, and a roller bracket 22 which supports the guide roller 21, as shown in FIGS. 2A to 2C, for example, and the roller bracket 22 is mounted on the transport dolly D to be able to rotate around a vertical shaft 23. The guide roller 21 is configured with a pair of guide rollers 21 which rolls in contact with both side surfaces of the first guide rail G1, as shown in FIG. 2A, for example. In addition, an operation of the guide member 2 will be described later.

As shown in FIG. 2B, a slide shoe 5 which slides on the floor F1 is disposed at each of the intermediate traveling rails RM and the intermediate guide rail GM. The slide shoe 5 is configured with a block of resin or the like mounted on the lower surface of each of the intermediate traveling rails RM and the intermediate guide rail GM and slides on the floor F1 when the intermediate traveling rails RM and the intermediate guide rail GM move with respect to the floor F1.

The slide shoe 5 is disposed immediately below or in the vicinity of, for example, each of the connection section 6 between each of the intermediate traveling rails RM and each of the first traveling rails R1 and the connection section 7 between the intermediate guide rail GM and the first guide rail G1. Further, the slide shoe 5 may also be disposed further toward the side close to the another floor F2 than the disposition location as described above. The slide shoes 5 maintain the heights of the intermediate traveling rails RM and the intermediate guide rail GM and support the weight of the transport dolly D which travels on the intermediate traveling rails RM. In addition, here, a case where the slide shoes 5 are disposed at the intermediate traveling rails RM and the intermediate guide rail GM has been described. However, the slide shoes 5 may be disposed on the floor F1.

As shown in FIG. 2C, a floorboard 11 for covering the distance C between the floor F1 and the another floor F2 is disposed at a lower portion of each of the intermediate traveling rails RM. The floorboards 11 are connected to both side surfaces of the intermediate guide rail GM, for example, and provided to extend toward the intermediate traveling rails RM. A bracket 12 which supports the floorboard 11 is connected to the inner surface of each of the intermediate traveling rails RM. In addition, a configuration may be made in which the floorboard 11 is connected to each of the intermediate traveling rails RM and the bracket 12 is connected to the intermediate guide rail GM. Here, there is a case where the transport system 1 is installed at a high place far from the ground (a floor). In such a case, by using the floorboards 11, it is possible to prevent a cargo from falling into the gap between the floor F1 and the another floor F2.

In this manner, the floorboard 11 is supported to be able to slide on the bracket 12, whereby even in a case where the gauge distance between the intermediate traveling rails RM varies, the floorboards 11 do not impede the behavior of the intermediate traveling rails RM, and even in a case where the gauge distance between the intermediate traveling rails RM spreads to a maximum extent, it is possible to support the floorboard 11 on the bracket 12.

The floorboard 11 is equivalent to a connecting corridor which configures a passage connecting the floor F1 and the another floor F2. Therefore, as shown in FIG. 1A, the floorboard 11 is configured to have a length greater than the distance C. Further, a sub-floorboard 13 may also be disposed on the outer surface of each of the intermediate traveling rails RM. Further, as shown in FIG. 1A, slide shoes 14 may be disposed at four corners of a connecting corridor which is configured with the floorboards 11 and the sub-floorboards 13. The slide shoes 14 are in contact with the floor F1 or the another floor F2 to be able to slide thereon. Here, the sub-floorboard 13 also exhibits the same effect as the floorboard 11 as described above.

Incidentally, it is necessary to prevent the traveling wheels D1 of the transport dolly D from derailing from the intermediate traveling rails RM even in a case where the gauge distance between the intermediate traveling rails RM varies due to the relative movement of the floor F1 and the another floor F2. Therefore, it is preferable that each of the traveling wheels D1 of the transport dolly D has a width W corresponding to the minimum value and the maximum value of the gauge distance occurring in the intermediate traveling rails RM due to the relative movement of the first traveling rails R1 and the second traveling rails R2.

Here, the gauge distance between the intermediate traveling rails RM has the maximum value in the normal state (a state where the floor F1 and the another floor F2 are stationary and a state where the first traveling rail R1, the intermediate traveling rail RM, and the second traveling rail R2 are disposed on a straight line), and the minimum value varies according to the relative movement angle θ due to the relative movement of the floor F1 and the another floor F2 (however, θ is less than 90°). Specifically, the width W of the traveling wheel D1 is set based on the conditions such as the size of the distance C between the floor F1 and the another floor F2, the relative movement amount (the relative movement angle θ) which is assumed, the gauge distance between the intermediate traveling rails RM, and a rail width of each of the intermediate traveling rails RM.

As shown in FIG. 3A, a slide shoe 8 which slides on the another floor F2 is disposed at each of the intermediate traveling rails RM and the intermediate guide rail GM. The slide shoe 8 is substantially the same component as the slide shoe 5 described above and has the same configuration as the slide shoe 5, and therefore, detailed description thereof is omitted here.

As shown in FIG. 3B, the plurality of wheels 3 which can roll on the another floor F2 are disposed at each of the second traveling rails R2 and the second guide rail G2 in the laying direction thereof. The substructure of each of the second traveling rails R2 and the second guide rail G2 has a U-shaped cross-section and an opening portion is formed downward. The wheel 3 is disposed in a concave portion of the U-shaped cross-section, for example.

Further, on the another floor F2, the plurality of guide rollers 4 are disposed along both side surfaces of each of the second traveling rails R2 and the second guide rail G2 in the laying direction thereof. The guide rollers 4 are disposed to pinch the side surfaces of the substructure of each of the second traveling rails R2 and the second guide rail G2 from both sides. Due to such a configuration, even in a case where the pair of second traveling rails R2 moves on the another floor F2, the gauge distance between the second traveling rails R2 is maintained at the same distance as the gauge distance between the first traveling rails R1.

Here, a modified example of the guide member 2 is shown in FIG. 3C. FIG. 3C is the same cross-sectional view along line e-e as in FIG. 3B. For example, as shown in the drawing, in a case where the superstructure of the second guide rail G2 has a U-shaped cross-section and an opening portion is formed upward, a single guide roller 21 may be inserted into a concave portion of the second guide rail G2 and disposed to roll in contact with the inner surfaces. Also in this case, the roller bracket 22 supporting the guide roller 21 is mounted on the transport dolly D to be able to rotate around the vertical shaft 23. Also by such a configuration, the same operation as for the guide member 2 described above is provided.

In addition, the slide mechanism of each of the second traveling rails R2 and the second guide rail G2 described above is not limited to the illustrated configuration, and for example, instead of the wheel 3, a slide shoe may be disposed, and instead of the guide roller 4, a guide rail provided with a low-friction sliding surface is also acceptable.

In the transport system 1 according to the first embodiment described above, as shown in FIG. 1A, a cargo receiving section 16 which receives a cargo from the transport dolly D is disposed on the another floor F2 in the side of the second traveling rail R2. The cargo receiving section 16 is configured with, for example, a roller conveyor, a belt conveyor, or the like, and a turntable 17 is disposed next to the cargo receiving section 16, and a storing and delivery section 18 is disposed next to the turntable 17.

Further, in the transport system 1 according to the first embodiment described above, at the time of storage in a warehouse, cargo placed on the storing and delivery section 18 is transferred to the cargo receiving section 16 via the turntable 17 and then transferred to the transport dolly D stopped adjacent to the cargo receiving section 16. The transport dolly D loaded with the cargo travels on the second traveling rails R2, the intermediate traveling rails RM, and the first traveling rails R1, thereby being transferred from an area of the another floor F2 (the normal floor) to an area of the floor F1 (the seismically isolated floor). The transport dolly D stops at the position of the predetermined transport device 15 and the cargo is then transferred to the transport device 15, and the cargo is stored in a predetermined rack by the transport device 15. At the time of delivery from a warehouse, a cargo is delivered from the rack to the storing and delivery section 18 via a reverse course.

Next, an operation of the transport system 1 according to this embodiment will be described in detail using FIGS. 4A to 4C and 5.

Figure 4A:
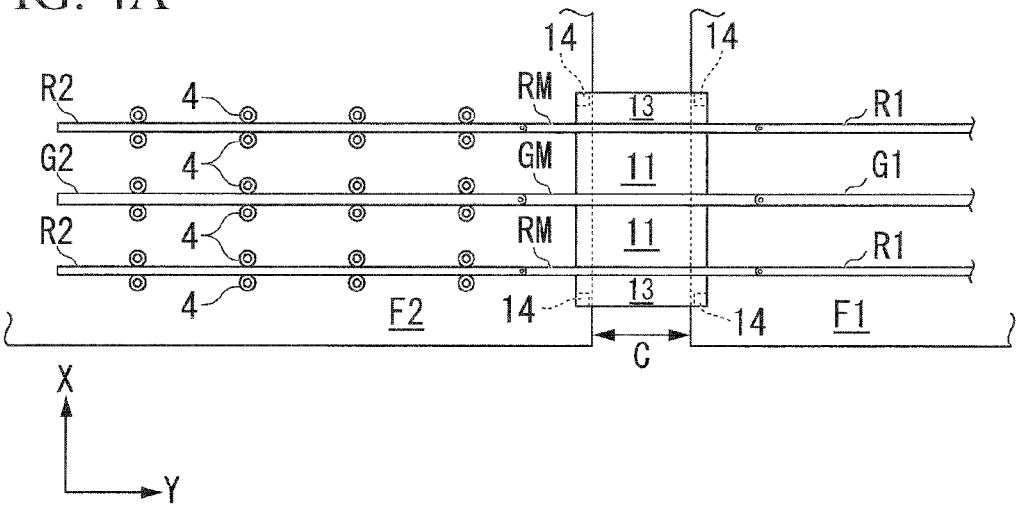
FIG. 4A is an explanatory diagram (a plan view at a normal time) showing an operation of the transport system shown in FIG. 1A.

FIG. 4A is a plan view when the floor F1 and the another floor F2 are in the normal state, and a direction perpendicular to each rail is set to be an X-axis and the laying direction (the length direction) of each rail is set to be a Y-axis. In this embodiment, the "normal state" means a state where the floor F1 and the another floor F2 are stationary and a state where the first traveling rail R1, the intermediate traveling rail RM, and the second traveling rail R2 are disposed on a straight line.

Figure 4B:
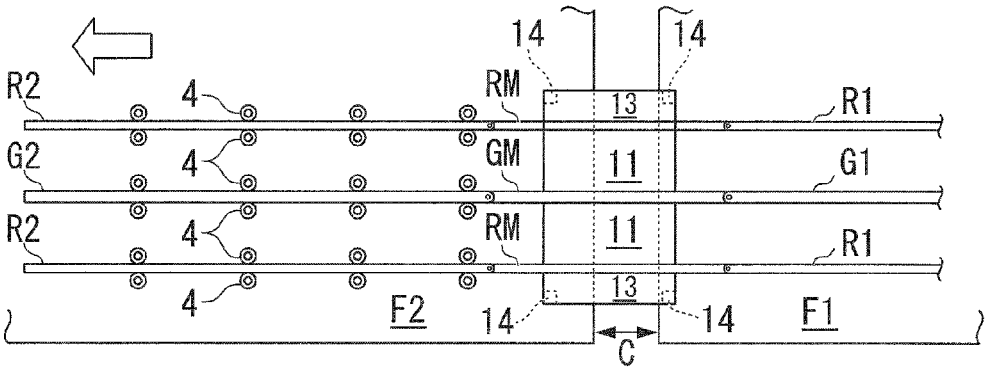
FIG. 4B is an explanatory diagram (a plan view when a floor and another floor have moved relative to each other in a Y-axis direction) showing an operation of the transport system shown in FIG. 1A.

In a case where the floor F1 and the another floor F2 move relative to each other in a Y-axis direction due to an earthquake, as shown in FIG. 4B, there is a case where the floor F1 comes close to the another floor F2 and thus the distance C becomes narrower than that in the normal state. At this time, the first traveling rails R1 and the first guide rail G1 also move with the movement of the floor F1, and the second traveling rails R2 and the second guide rail G2 are pushed out in the negative direction of the Y-axis by the intermediate traveling rails RM and the intermediate guide rail GM. Then, the second traveling rails R2 and the second guide rail G2 slide on the another floor F2 while being guided by the guide rollers 4. Therefore, it is possible to absorb the movement amount due to the relative movement in the Y-axis direction, and it is possible to prevent breakage of the rails, and thus it is possible to prevent derailment or the falling of the transport dolly D.

Although not shown in drawings, in a case where the floor F1 and the another floor F2 move relative to each other in the Y-axis direction due to an earthquake, there is a case where the floor F1 moves away from the another floor F2 and thus the distance C becomes wider than that in the normal state. At this time, the second traveling rails R2 and the second guide rail G2 are pulled in the positive direction of the Y-axis through the intermediate traveling rails RM and the intermediate guide rail GM with the movement of the first traveling rails R1 and the first guide rail G1, and the second traveling rails R2 and the second guide rail G2 slide on the another floor F2 while being guided by the guide rollers 4.

Figure 4C:
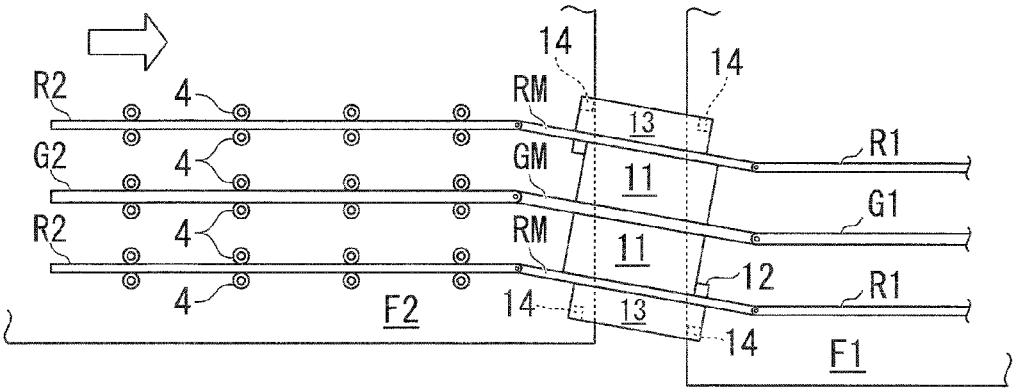
FIG. 4C is an explanatory diagram (a plan view when a floor and another floor have moved relative to each other in an X-axis direction) showing an operation of the transport system shown in FIG. 1A.

Further, in a case where the floor F1 and the another floor F2 move relative to each other in an X-axis direction due to an earthquake, as shown in FIG. 4C, each of the intermediate traveling rails RM is rotated with respect to each of the first traveling rails R1 and each of the second traveling rails R2, and accordingly, each of the second traveling rails R2 slightly slides in the Y-axis direction with respect to the another floor F2 while being guided by the guide rollers 4. Similarly, the intermediate guide rail GM is rotated with respect to the first guide rail G1 and the second guide rail G2, and accordingly, the second guide rail G2 slightly slides in the Y-axis direction with respect to the another floor F2 while being guided by the guide rollers 4.

In this manner, due to fixing the first traveling rails R1 to the floor F1, disposing the second traveling rails R2 to be able to move in the Y-axis direction with respect to the another floor F2, and connecting each of the intermediate traveling rails RM to be able to rotate with respect to each of the first traveling rails R1 and with respect to each of the second traveling rails R2, even in a case where the floor F1 and the another floor F2 move relative to each other in the X-axis direction and the Y-axis direction due to an earthquake, it is possible to absorb the movement amount, and thus it is possible to prevent breakage of the rails. Further, by preventing breakage of the rails, it is possible to prevent derailment or the falling of the transport dolly D. The same applies to the first guide rail G1, the intermediate guide rail GM, and the second guide rail G2.

In addition, in an actual earthquake, there is also a case where the direction of the relative movement of the floor F1 and the another floor F2 is a direction oblique to the X-axis direction and the Y-axis direction. However, the movement in the oblique direction can be resolved into a component in the X-axis direction and a component in the Y-axis direction, and in the result, it can be described in the states shown in FIGS. 4B and 4C.

Further, as shown in FIGS. 4A to 4C, the distance C between the floor F1 and the another floor F2 is covered with the floorboards 11 and the sub-floorboards 13. The length in the Y-axis direction of each of the floorboard 11 and the sub-floorboard 13 is set to correspond to the maximum value of the relative movement amount in the Y-axis direction, which is assumed. Further, each of the floorboards 11 is disposed to be able to slide on the bracket 12. For this reason, as shown in FIG. 4C, even in a case where the intermediate traveling rails RM and the intermediate guide rail GM move in the X-axis direction, the floorboards 11 neither interfere with the movement of the intermediate traveling rails RM and the intermediate guide rail GM nor fall.

Next, a case where the floor F1 and the another floor F2 move relative to each other in the X-axis direction while the transport dolly D is traveling on the intermediate traveling rails RM will be described with reference to FIG. 5.

Figure 5:
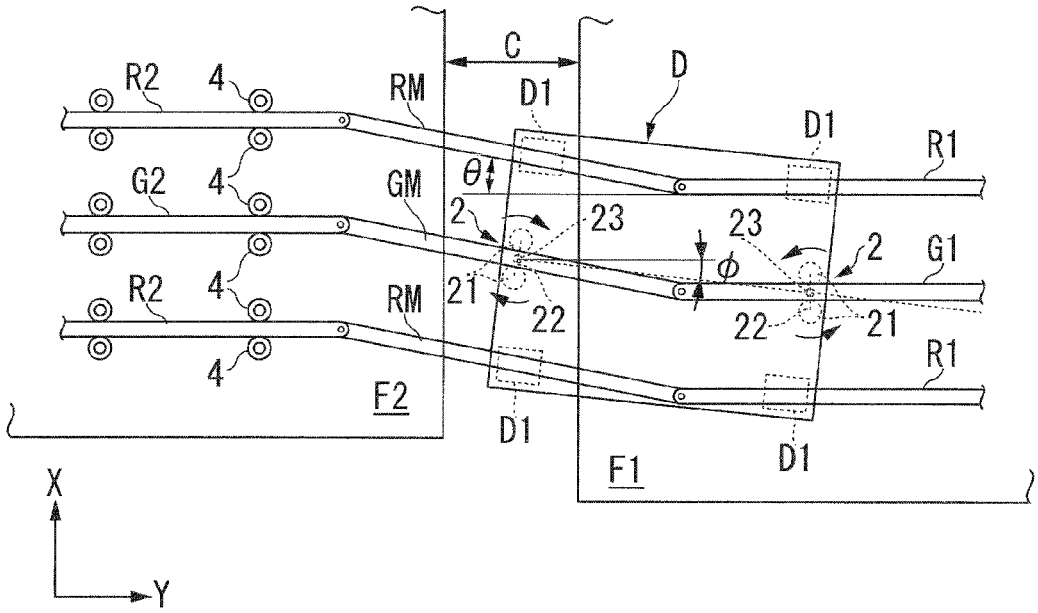
FIG. 5 is a plan view showing the behavior of a traveling dolly when the floor and the another floor have moved relative to each other in the X-axis direction.

As shown in FIG. 5, the guide members 2 are disposed at two front and rear locations on the transport dolly D, for example. In this manner, the guide members 2 are disposed at a front portion and a rear portion of the transport dolly D, whereby it is possible to stabilize the guidance of the transport dolly D. Further, the arrangement locations of the guide members 2 or the number of guide members 2 which are disposed is not limited to the illustrated example, and the guide member 2 may be disposed at one location of a central portion, or the guide members 2 may be disposed at three or more locations.

As shown in FIG. 5, for example, in a case where the guide member 2 on a first side is located on the intermediate guide rail GM and the guide member 2 on a second side is located on the first guide rail G1, the transport dolly D is rotated by an angle $\phi$ with the rotation of the intermediate guide rail GM. The angle $\phi$ is smaller than the relative movement angle $\theta$ of the intermediate guide rail GM. If a difference between the rotation angle $\phi$ of the transport dolly D and the relative movement angle $\theta$ is not absorbed, the guide member 2 interferes with the intermediate guide rail GM or the first guide rail G1, thereby causing damage. Therefore, in this embodiment, the roller bracket 22 supporting the guide roller 21 is configured to be able to rotate around the vertical shaft 23, thereby absorbing the difference.

Figure 6:
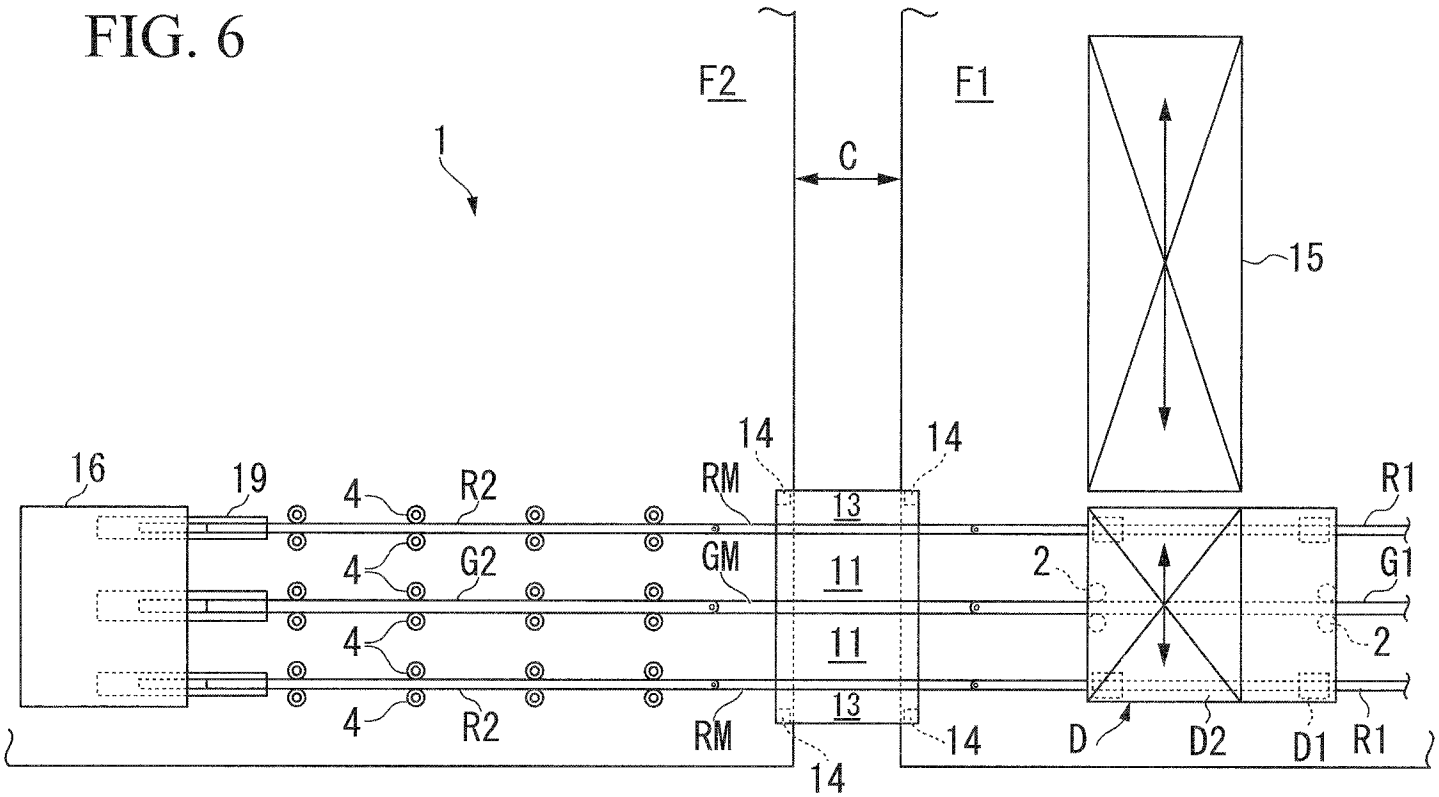
FIG. 6 is a plan view showing a transport system according to a second embodiment of the present disclosure.

Here, FIG. 6 is a plan view showing a transport system 1 according to a second embodiment of the present disclosure. In the transport system 1 according to the second embodiment, the cargo receiving section 16 is disposed in the laying direction of the second traveling rails R2 and the second guide rail G2. At this time, guide rail sections 19 guiding the second traveling rails R2 and the second guide rail G2 may be disposed in front of the cargo receiving section 16. Further, although not shown in the drawing, a turntable is disposed in the side of the cargo receiving section 16 or next to the cargo receiving section 16 in the laying direction of the traveling rails, and a storing and delivery section is disposed next to the turntable. Other configurations are the same as those in the first embodiment described above, and therefore, a detailed description thereof is omitted here.

Figure 7A:
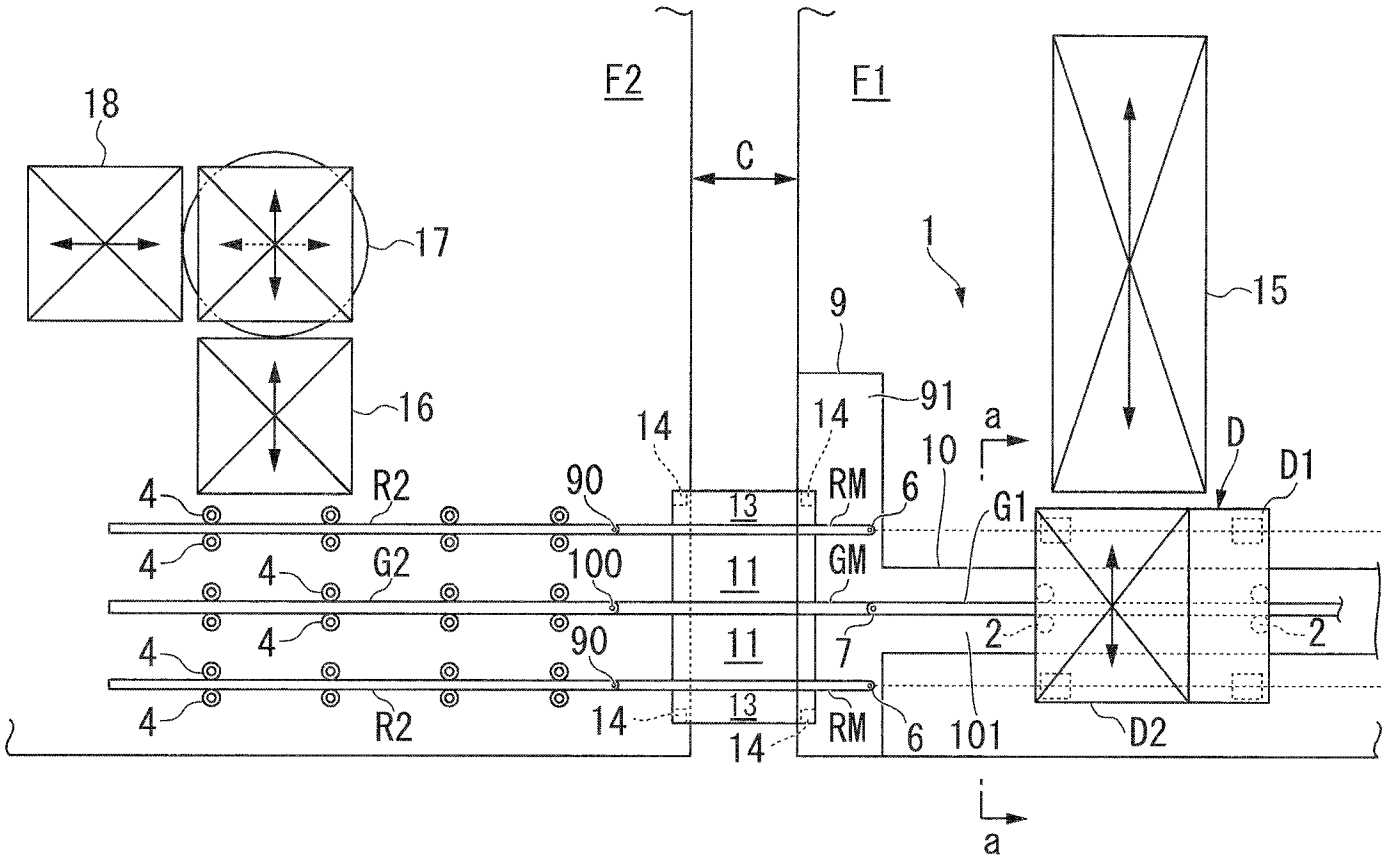
FIG. 7A is a plan view showing a transport system according to a third embodiment of the present disclosure.
Figure 7B:
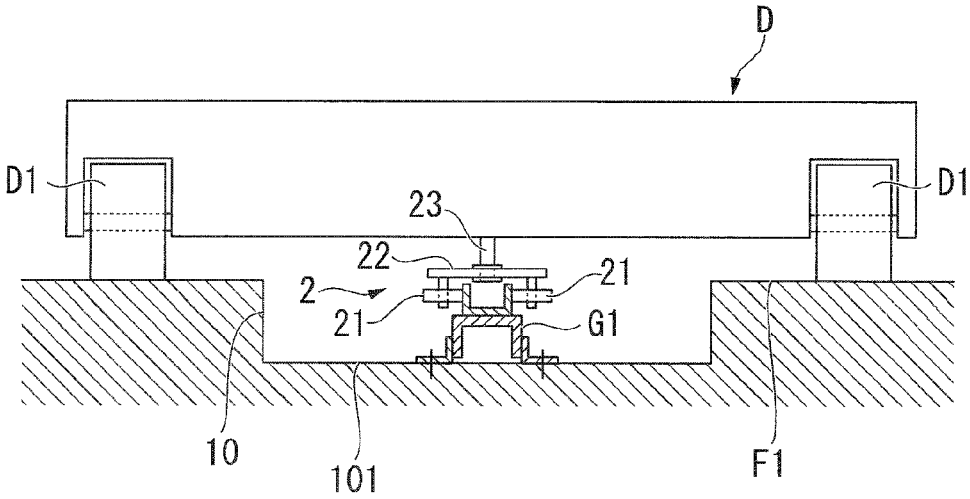
FIG. 7B is a cross-sectional view along line a-a in FIG. 7A.

Further, FIG. 7A is a plan view of a transport system according to a third embodiment of the present disclosure, and FIG. 7B is a cross-sectional view along line a-a in FIG. 7A. The transport system 1 according to the third embodiment causes the transport dolly D to directly travel on the floor F1, instead of the first traveling rails R1. A first stepped portion 9 which is formed in a portion facing the another floor F2 and has a wide width and a second stepped portion 10 which communicates with the first stepped portion 9 and has a narrow width are formed in the floor F1.

The intermediate traveling rails RM and the intermediate guide rail GM are respectively rotatably connected to a bottom portion 91 of the first stepped portion 9 by the connection sections 6 and the connection section 7. Therefore, the intermediate traveling rails RM and the intermediate guide rail GM are configured so that they can move relative to the floor F1 on the same plane as the bottom portion 91 of the first stepped portion 9. The width of the first stepped portion 9 is formed to a size in which the intermediate traveling rails RM, the intermediate guide rail GM, and the floorboards 11 or the sub-floorboards 13 do not come into contact with the floor F1 when the intermediate traveling rails RM and the intermediate guide rail GM are rotated. Further, the depth of the first stepped portion 9 is formed such that the upper surface of the floor F1 and the height of each of the intermediate traveling rails RM coincide with each other. Further, the first guide rail G1 is laid on a bottom portion 101 of the second stepped portion 10.

Due to such a configuration, the upper surface of the floor F1 is used as a traveling path, whereby a first traveling rail is omitted, and thus it is possible to reduce the number of rail laying processes and it is possible to reduce the cost of the transport system 1. In addition, other configurations are the same as those in the first embodiment described above, and therefore, a detailed description thereof is omitted here.

Further, in the case of the third embodiment, the floors F1 in the right-left direction of the second stepped portion 10 are equivalent to a pair of first traveling paths which is configured not to move relative to a floor. Further, the second traveling rails R2 are equivalent to a pair of second traveling paths laid on the another floor F2 to be able to move in the laying direction of the second traveling paths. Further, the intermediate traveling rails RM are equivalent to a pair of intermediate traveling paths each including a first end and a second end, the first end being rotatably connected to the floor F1, the second end being rotatably connected to an end portion of each of the second traveling paths.

The preferred embodiments of the present disclosure have been described above with reference to the accompanying drawings. However, of course, the present disclosure is not limited to each of the embodiments described above, and various altered examples or modified examples in the scope stated in the claims also belong to the technical scope of the present disclosure.

For example, the transport system 1 described above is not limited to a use in the automatic warehouse and can be used with respect to all buildings and structures including the floor F1 and the another floor F2 which can move relative to each other.

INDUSTRIAL APPLICABILITY

According to the transport system according to the present disclosure, even in a case where the floor and the another floor move relative to each other due to an earthquake or the like, it is possible to prevent breakage of the traveling paths, and thus it is possible to prevent derailment or the falling of the transport dolly.

What is claimed is:

1. A transport system configured to transport a cargo between a floor and another floor which are disposed with a distance therebetween and are able to move relative to each other, the transport system comprising:

a pair of first traveling paths configured not to move relative to the floor;

a pair of second traveling paths laid on the another floor to be able to move in a laying direction thereof;

a pair of intermediate traveling paths each including a first end and a second end, the first end being connected to an end portion of each of the first traveling paths or the floor such that the pair of intermediate traveling paths is rotatable in a horizontal plane, the second end being connected to an end portion of each of the second traveling paths such that the pair of intermediate traveling paths is rotatable in the horizontal plane; and a transport dolly configured to travel on the first traveling paths, the intermediate traveling paths, and the second traveling paths.

2. The transport system according to claim 1, further comprising:

a first guide rail laid parallel to the first traveling paths and affixed to the floor;

a second guide rail laid parallel to the second traveling paths and able to move in the laying direction thereof on the another floor; and an intermediate guide rail including a first end and a second end, the first end being rotatably connected to an end portion of the first guide rail, the second end being rotatably connected to an end portion of the second guide rail, wherein the transport dolly has a guide member movable along the first guide rail, the intermediate guide rail, and the second guide rail.

3. The transport system according to claim 2, wherein the guide member is provided with a guide roller which can roll along the first guide rail, the intermediate guide rail, and the second guide rail, and a roller bracket which supports the guide roller, and the roller bracket is mounted on the transport dolly to be able to rotate around a vertical shaft.

4. The transport system according to claim 1, wherein a traveling wheel of the transport dolly has a width such that the traveling wheel of the transport dolly can travel on each of the intermediate traveling paths when a gauge distance of the intermediate traveling paths is within a minimum value and a maximum value due to a relative movement of the first traveling paths and the second traveling paths.

5. The transport system according to claim 2, wherein a traveling wheel of the transport dolly has a width such that the traveling wheel of the transport dolly can travel on each of the intermediate traveling paths when a gauge distance of the intermediate traveling paths is within a minimum value and a maximum value due to a relative movement of the first traveling paths and the second traveling paths.

6. The transport system according to claim 3, wherein a traveling wheel of the transport dolly has a width such that the traveling wheel of the transport dolly can travel on each of the intermediate traveling paths when a gauge distance of the intermediate traveling paths is within a minimum value and a maximum value due to a relative movement of the first traveling paths and the second traveling paths.

7. The transport system according to claim 1, wherein a floorboard configured to cover a distance between the floor and the another floor is disposed at a portion below each of the intermediate traveling paths.

8. The transport system according to claim 2, wherein a floorboard configured to cover a distance between the floor and the another floor is disposed at a portion below each of the intermediate traveling paths.

9. The transport system according to claim 3, wherein a floorboard configured to cover a distance between the floor and the another floor is disposed at a portion below each of the intermediate traveling paths.

10. The transport system according to claim 1, wherein a cargo receiving section which receives a cargo from the transport dolly is disposed at the another floor in the side of the second traveling paths.

11. The transport system according to claim 2, wherein a cargo receiving section which receives a cargo from the transport dolly is disposed at the another floor in the side of the second traveling paths.

12. The transport system according to claim 3, wherein a cargo receiving section which receives a cargo from the transport dolly is disposed at the another floor in the side of the second traveling paths.

13. The transport system according to claim 4, wherein a floorboard for covering a distance between the floor and the another floor is disposed at a portion below each of the intermediate traveling paths.

14. The transport system according to claim 5, wherein a floorboard for covering a distance between the floor and the another floor is disposed at a portion below each of the intermediate traveling paths.

15. The transport system according to claim 6, wherein a floorboard for covering a distance between the floor and the another floor is disposed at a portion below each of the intermediate traveling paths.

16. The transport system according to claim 4, wherein a cargo receiving section which receives a cargo from the transport dolly is disposed at the another floor at a side of the second traveling paths.

17. The transport system according to claim 5, wherein a cargo receiving section which receives a cargo from the transport dolly is disposed at the another floor at a side of the second traveling paths.

18. The transport system according to claim 6, wherein a cargo receiving section which receives a cargo from the transport dolly is disposed at the another floor at a side of the second traveling paths.

19. The transport system according to claim 7, wherein a cargo receiving section which receives a cargo from the transport dolly is disposed at the another floor at a side of the second traveling paths.

20. The transport system according to claim 8, wherein a cargo receiving section which receives a cargo from the transport dolly is disposed at the another floor at a side of the second traveling paths.

* * * * *